US011464368B2

(12) United States Patent
Kilic

(10) Patent No.: US 11,464,368 B2
(45) Date of Patent: Oct. 11, 2022

(54) DEVICE FOR DISPENSING A LIQUID PRODUCT

(71) Applicant: ICON GUEST CONCEPTS & SUPPLY GMBH, Berlin (DE)

(72) Inventor: Korhan Kilic, Berlin (DE)

(73) Assignee: ICON GUEST CONCEPTS & SUPPLY GMBH, Berlin (DE)

( * ) Notice: Subject to any disclaimer, the term of this patent is extended or adjusted under 35 U.S.C. 154(b) by 0 days.

(21) Appl. No.: 16/970,429

(22) PCT Filed: Nov. 12, 2019

(86) PCT No.: PCT/EP2019/080985
§ 371 (c)(1),
(2) Date: Aug. 17, 2020

(87) PCT Pub. No.: WO2020/099379
PCT Pub. Date: May 22, 2020

(65) Prior Publication Data

US 2021/0321830 A1 Oct. 21, 2021

(30) Foreign Application Priority Data

Nov. 12, 2018 (DE) ..... 202018106397.9

(51) Int. Cl.
*A47K 5/12* (2006.01)
*B05B 11/00* (2006.01)

(52) U.S. Cl.
CPC ..... *A47K 5/1205* (2013.01); *B05B 11/0038* (2018.08); *A47K 2201/025* (2013.01)

(58) Field of Classification Search
CPC ..... A47K 5/1205; B05B 11/0038
USPC ... 222/570, 93, 94, 105, 106, 160, 156, 173, 222/183, 181.3, 181.2, 153.03; 383/80
See application file for complete search history.

(56) References Cited

U.S. PATENT DOCUMENTS 5,421,485 A * 6/1995 Furuta ..... B05B 11/00412 222/95
6,247,621 B1 * 6/2001 Lewis ..... A47K 5/12 222/321.8
7,134,577 B1 * 11/2006 Verma ..... B05B 11/0037 222/321.9
8,893,928 B2 * 11/2014 Proper ..... A47K 5/14 222/173
10,376,910 B2 * 8/2019 Okude ..... B05B 11/0008
10,493,479 B1 * 12/2019 Huang ..... B05B 11/3074
10,518,279 B2 * 12/2019 Okude ..... B65D 77/06
2005/0218159 A1 * 10/2005 Hoour ..... B65D 25/205 222/321.7

(Continued)

FOREIGN PATENT DOCUMENTS

CA 2916652 A1 * 6/2014
DE 102010024081 A1 12/2011

(Continued)

OTHER PUBLICATIONS

Int'l Search Report for PCT/EP2019/080985, dated Feb. 4, 2020.

*Primary Examiner* — Lien M Ngo
(74) *Attorney, Agent, or Firm* — Blue Filament Law PLLC

(57) ABSTRACT

A device for dispensing a liquid product is provided that includes a receiving body, a locking and fastening device and an adapter device. A kit is also provided that includes a device for dispensing a liquid product and an auxiliary tool.

22 Claims, 10 Drawing Sheets

(56) References Cited

U.S. PATENT DOCUMENTS

Figure 1:
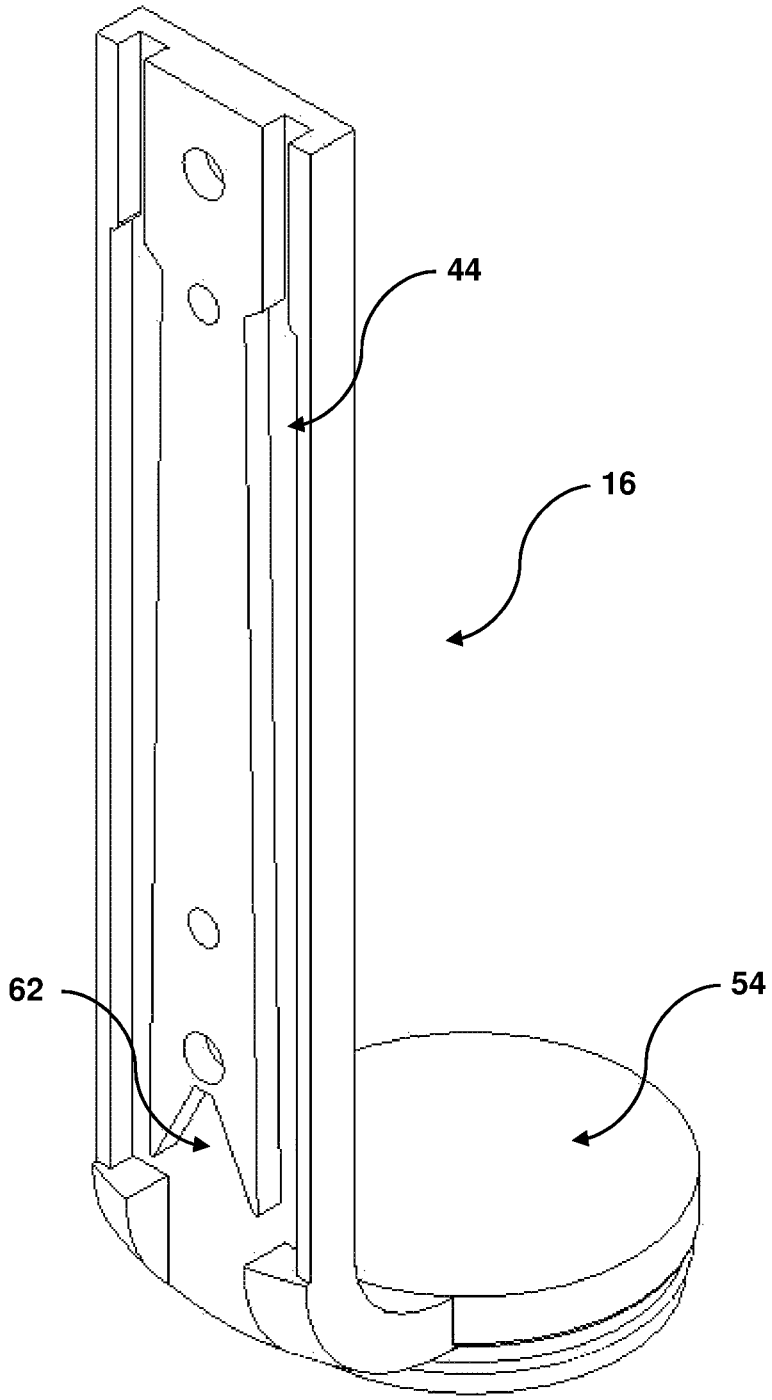

| | | | | |
|---|---|---|---|---|
| 2008/0237248 | A1 | 10/2008 | Dente et al. | |
| 2012/0199609 | A1 | 8/2012 | Schwenkenberg | |
| 2013/0092708 | A1 | 4/2013 | Geiberger | |
| 2016/0040455 | A1 | 2/2016 | Limbert et al. | |
| 2016/0288151 | A1* | 10/2016 | Schultz | F16M 11/105 |
| 2016/0332779 | A1 | 11/2016 | Patel | |
| 2021/0291231 | A1* | 9/2021 | Ando | B06B 1/0651 |

FOREIGN PATENT DOCUMENTS

| | | | |
|---|---|---|---|
| DE | 102014007298 | A1 | 11/2015 |
| DE | 102017122729 | A1 | 4/2019 |
| EP | 2522783 | A1 * | 11/2012 |
| WO | 2011098234 | A1 | 2/2011 |

* cited by examiner

DEVICE FOR DISPENSING A LIQUID PRODUCT

The invention relates to a device for dispensing a liquid product, the device comprising a receiving body, a locking and fastening device and an adapter device. In a further aspect, the invention relates to a kit comprising a device for dispensing a liquid product and an auxiliary tool.

STATE OF THE ART

State of the art soap dispenser devices are known to dispense to a user soap, other liquid or foamy care products or cleaning agents to a user. The care products or cleaning agents are preferably referred to as liquid products and specified below. In particular, in the commercial sector, for example in hotels, devices are known which comprise a container for the liquid product which may be pressed or squeezed. The container is made of a material exhibiting a certain elasticity to this end, so that pressing causes the liquid product to be squeezed out of the container. If an opening is provided in the lower region of such a soap dispenser, the liquid product may leave the container through said opening being dispensed into the hand of a user.

One disadvantage of soap dispensers operating by a squeeze or press mechanism, relate to the large area in which the container is necessarily touched by different users upon pressing or squeezing. Contaminations may stick to the outside of the container. If the contaminations contain pathogens, they can be transferred from a user to user. A further disadvantage relates to a relatively large force which is often required to squeeze the container. Such a force may not be able to be readily applied by small children or elderly people, which thus may have difficulty using a squeeze mechanism based soap dispenser. In particular, squeezing the bottle requires practically all the fingers of one hand, which can be disadvantageous because it may complicate handling the bottle or soap dispenser. In addition, the material from which the squeeze container is made may become brittle, may break or show damage in certain areas due to a frequent squeezing or external stresses such as temperature or humidity to which the container is subjected.

Soap dispensers are also known from the state of the art, in which the liquid product is likewise dispensed downwards, but which have a pressure mechanism in the front area of the soap dispenser. The liquid product can also be dispensed by means of a lever or bracket located in the lower region of the soap dispenser. Such soap dispensers often exhibit plastic boxes forming the soap dispenser or resemble automatic machines. Often, they are mounted on walls next to a washstand. A disadvantage of such soap dispensers is that the liquid product dispensed frequently falls to the floor, causing contamination of the bathroom or toilet floor. The liquid dropping on the floor are not only unaesthetic, but may also pose a safety risk, if a person slips on the soap film. If the soap dispenser is installed above a washstand, it may equally be contaminated by a dripping liquid product. The cleaning effort required by cleaning personnel is undesirably increased.

In the prior art soap dispensers are also known in which the soap is dispensed upwards. Such soap dispensers are often fixed to the wall or washstand by means of a wire, plastic or metal frame to protect the soap dispenser and its contents from theft. However, the presence of the wire, plastic or metal frame has the undesirable effect of conveying the feeling of potential thief, since the design of the security frame implies that the soap dispenser the hotel takes measures to avoid a possible removal. In addition, the wire or metal frames are often visually unattractive. A further important disadvantage of the frames is that soap residues, bacteria and/or even mold cultures may form and accumulate in an area where, the frame is connected to the soap dispenser. Concrete health hazard can arise from such contaminations. Furthermore, it has been shown that wire, plastic or metal racks often take up a large amount of space, so that space-saving mounting solutions are practically impossible.

In the light of the known prior art the present invention is based on the objective to provide a device for dispensing a liquid product which does not exhibit the defects and disadvantages of conventional soap dispensers. In addition, the device should be particularly safe against manipulation so that unauthorized third parties cannot introduce foreign substances into the liquid product. The soap dispenser should be visually appealing and easy and intuitive to operate. The soap dispenser should allow hygienic dispensing of the liquid product and space-saving installation. Furthermore, the soap dispenser should be easy and quick to clean and maintain by trained personnel. This applies in particular to the replacement of the soap container, when the liquid product in the soap container is nearly vanished. For this purpose, it would be desirable, if the filling level inside the soap dispenser can be easily determined by the personnel.

DESCRIPTION OF THE INVENTION

The objective is solved by the features of independent claims. Advantageous features of the invention are described in the dependent claims. According to the invention, a device for dispensing a liquid product is provided, the device comprising a receiving body, a locking and fastening device and an adapter device. The device is characterized in that the receiving body is of multi-part design and comprises at least one inner container for receiving the liquid product and an outer container of a two-part design, the outer container comprising an upper part and a lower part and being adapted to receive the inner container, wherein the receiving body can be fastened to the adapter device by means of the locking and fastening device.

It is particularly preferred in the sense of the invention that the device of the outer container is formed at least in two parts. Herein, it may also be preferred that the outer container comprises three, four, five or six components, without being limited thereto. For example, a lateral closure may also be provided on the outer container.

It is preferred in the sense of the invention to refer to the device as a soap dispenser. The liquid product is preferably liquid soap, but the device is also suitable, for dispensing without limitation shampoo, hair wash products, shower gel, conditioner for hair, hand sanitizer, sun cream, massage or therapy oils, medical preparations, perfumes, room spray, water or water spray, body lotion, disinfectant, care and/or cleaning products in liquid form. The products mentioned are preferably referred to as liquid products. The use of the term "soap dispenser" is therefore preferably a shortened term for a proposed liquid product dispenser. The proposed soap dispenser can also be used in the food sector, for example for ketchup, mayonnaise or mustard, syrup, sauces, oils. In particular, it may be preferable in the sense of the invention to use the proposed soap dispenser in restaurants, public toilets, hotels, at airlines, in airplanes, on cruise ships, hospitals, office buildings, fitness studios, schools and/or day-care centers, without intending to be limited to said examples.

The proposed soap dispenser advantageously combines an intuitive and easy-to-use pumping mechanism with an attractive and high-quality exterior. To this end in particular the multi-part receiving body comprising an inner container and a two-part outer container ensures economic use. The latter feature relating to a multi-part receiving body with a two-part outer container and an inner container is preferably referred to as an "inner refill cartridge" in the sense of the invention. Especially in the field of commercial guest care, the invention represents an interesting alternative to known dispenser systems or other provision variants, such as portion packaging for personal care products used in some hotels, due to its "invisible" protection against theft and manipulation. The formulation that the outer container is formed in two parts is to be understood in the sense of the invention in particular as meaning that the outer container comprises at least two components. It may also be preferred in the sense of the invention that the outer container comprises more than two, i.e. for example three, four, five or more components. It is particularly preferred in the sense of the invention that the lower part of the outer container itself is not designed as a container but essentially forms a lower bottom plate of the outer container. The outer container preferably comprises an upper part, which can be designed like the upper part of a bottle, for example, and a lower part, which can be designed like the bottom of a bottle, for example. Such a configuration shall also be covered by the term "multipart outer container" in the sense of the invention. It may also be preferred in the sense of the invention that the lower part of the outer container is formed by a lower part of the adapter. In said preferred embodiment of the invention, the outer container comprises an upper part and a lower part, the lower part being formed by a component of the adapter device. For example, the base or platform may serve as the lower part of the outer container.

The proposed structure of the soap dispenser has proven to be particularly advantageous since it eliminates the need for an external rack to hold the soap dispenser. Such a rack is used for conventional soap dispensers in the commercial sector, for example in hotels or cruise ships, to mount the soap dispenser onto a wall. However, such racks are visually unattractive on the one hand, and on the other hand convey the undesirable impression to a user of being considered a potential thief. The proposed construction advantageously allows that the soap dispenser can be fixated to a wall or a base without any fasteners that would negatively impacting the visual impression.

In particular a user of the device is not given the impression to be suspected of wanting to steal the soap dispenser or its contents. Furthermore, the absence of a rack prevents the formation or accumulation of mold or other contaminants. Furthermore, the proposed soap dispenser, which does not require a rack, does not negatively affect the overall visual impression of a bathroom. A particular advantage of the proposed soap dispenser is that it is designed to appear particularly simple and elegant for the user, while the proposed construction with a receiving body, locking and fastening device and adapter device overcomes a number of disadvantages described in the prior art and proposes further improvements. In particular, the provision of a multi-part receiving body, which comprises in particular an inner and an outer container, increases the resistance of the proposed soap dispenser to undesirably manipulation. Unauthorized third party may not easily gain access to the inner container of the receiving body in which the liquid product is located. In this respect, the present invention fulfils particularly high safety requirements against manipulation and undesired contamination of the liquid product without the need of extensive and visually impairing safety precautions.

The receiving body (or receptable) is of a multi-part design in the sense that the receiving body comprises at least one inner container and one outer container of a two-part design. Preferably the receiving body forms the lower part of the soap dispenser device, which in the sense of the invention is preferably also referred to as the "bottle" of the soap dispenser. The provision of an inner and an outer container which together form a receiving body is preferably referred to as a "bottle-in-bottle" system according to the invention. Such "bottle-in-bottle" systems are not yet known in the field of commercial liquid product dispensers. In the sense of the invention, it is particularly preferred that the inner container is adapted to hold the liquid product. Preferably, the inner container is adapted to hold a volume of at least 100 ml of liquid product, preferably at least 300 ml. For example, bottle sizes with a capacity of 100 ml, 150 ml, 200 ml, 250 ml, 300 ml, 400 ml, 500 ml, 1000 ml, 2000 ml or larger, smaller and intermediate values may be preferred. For example, if the device is used for perfumes or aromatherapy products, it may also be preferred that the inner container is adapted to hold a volume of 10 ml or volumes between 10 and 100 ml. As a consequence, the inner container does not have to be replaced or refilled as often. In the sense of the invention, it is particularly preferred that the inner container is replaced when it is empty or when the level of the liquid product approaches the bottom surface of the inner container. In case of replacement, preferably the empty or substantially empty (inner) container is removed from the soap dispenser and replaced by another, preferably full, (inner) container. The inner container may include, for example, PET, PP, PE, PVC, aluminum composites. However, it may also be preferred in the sense of the invention that the inner container instead or in addition comprises or is formed from biodegradable materials such as cardboard, wood fibres or other plastic substitutes. It is particularly preferred in the sense of the invention that the inner container is formed by a stable bottle. However, it may also be preferred that the inner container is formed by a bag-like structure. This is particularly advantageous if the inner container is designed as a disposable product, since the associated waste volume can be considerably reduced by a bag-like formation. It is preferred that the inner container can be produced as a disposable product at a particularly favorable price, while the outer container, or its upper and lower part, can be of a particularly high-quality and visually appealing design.

By providing an inner container within the proposed soap dispenser, several needs from the hotel and travel industry can be met or implemented particularly well. On the one hand, the provision of the liquid product meets high hygiene standards because—unlike conventional soap dispensers which are regularly refilled—no contaminations may reach the liquid product. Since the inner container can only be replaced by authorized personnel, for example the housekeeping staff in a hotel, on an aircraft or on a cruise ship, it is furthermore prevented that users deliberately and intentionally contaminate or manipulate the soap dispenser or the liquid product as its contents. On the one hand, this increases the subjective feeling of safety and cleanliness of the users and on the other hand it prevents such incidents from actually happening. In particular, the proposed soap dispenser aids to avoid legal claims for damages or other legal actions against the hotel operator or airline, as the risk of bodily injury and/or transmitted diseases caused by contamination and/or mould using the soap dispenser is effectively reduced. For the supplier of liquid products or soap dispensers of the type proposed, the invention has the further advantage of tying the customer, for example a hotel chain, airline or cruise operator, to a particular manufacturer or supplier, since the customer must purchase the exchange containers filled with the liquid product through the supplier. This is achieved in particular by the fact that the locking and fastening device of the soap dispenser includes means to prevent unwanted opening and/or replacement of the inner container by unauthorized persons. Authorized persons are in particular those who—as described above—work in housekeeping or are entrusted with the maintenance of the soap dispenser system. Preferably authorized personal will be provided with an auxiliary tool for releasing the locking and fastening device from a locked state, such that firstly the upper part of the outer container can be released from its lower part and subsequently the inner container can be removed from the lower part of the outer container. The embodiment preferably enables the inner container, which is empty for example, to be replaced by a new inner container, which is filled with the liquid product for example. An auxiliary tool in the sense of the invention can also refer to a lever or a lever action, for example. The auxiliary tool may, for example, be an additional means, such as a key, with which the locking and fastening device can be externally released. However, in terms of the invention it may also be preferred that the auxiliary tool is integrated in the device, for example if it is a lever for releasing the locking and fastening device.

In addition, the locking and fastening device may include means to prevent unwanted opening and/or replacement of the inner container by unauthorized persons. The preferred means may include, for example, so-called friction fit means. These may, for example, be formed by a friction or toothed ring or friction surfaces which are located in the preferably neck-shaped transition area between the container and the screw cap and which are designed to prevent unwanted opening and/or replacement of the inner container by unauthorized persons. The friction fit means can act mechanically as described above, if they are formed by a gear rim or friction surface, for example. However, the occurrence of friction can also be achieved, for example, by bonding the components of the proposed soap dispenser. Another possibility for connecting the screw cap is a press-fit connection, in which the screw cap is preferably pressed onto the bottle neck from above and cannot be removed afterwards. As a consequence, the cap is made "tamper proof".

The proposed soap dispenser shall also include an outer container comprising at least two parts. The two-part design of the outer container is preferably expressed by the fact that the outer container comprises an upper part and a lower part which can preferably be fitted into each other. To this end, the upper part of the outer container may, for example, comprise in a lower region an annular region which has a slightly smaller external diameter than the remaining upper part. In particular, the outside diameter of this annular region may be slightly smaller than the inside diameter of an upper region of the lower part of the outer container, so that a stable but nevertheless easily detachable connection is formed between the upper part and the lower part of the outer container. The matching of the outer and inner diameters of the upper part and the lower part of the outer container is preferably also referred to in the sense of the invention as a corresponding formation of the said diameters to one another.

The outer container is moreover adapted to hold the inner container. In other words, the inner container can, for example, be placed into the lower part of the outer container and the combination of inner container and lower part can subsequently be covered with the upper part, similar to a Russian matryoshka doll. It is preferred in the sense of the invention that the inner container is enclosed or wrapped by the outer container.

The proposed soap dispenser includes a locking and fastening device that allows the containers to be attached to an adapter device. In particular, the upper part of the locking and fastening device can be used to lock up the inner container containing the liquid product. For this purpose, the upper part of the inner container is designed similarly to a bottle, for example a mineral water bottle. The upper part of the inner container comprises an opening through which the liquid product can be filled into the container. An external thread or a friction-fit or press-fit connection is preferably provided on the outside of this filling area. At the level of this external thread, a transition area of the locking and fastening device may be arranged, in particular a hollow cylinder-shaped area of this transition area. It may also be surrounded by a lid. In the opening of the inner container, a conventional pumping mechanism may also be provided with which the liquid product can be conveyed upwards or outwards from the inner container. It may be preferred in the sense of the invention that the pump mechanism or its constituent parts and/or components are equally adapted to lock the inner container, the upper region of the inner container preferably being surrounded by the hollow cylinder-like region of the transition region, whereby a closing effect is preferably achieved. The pump mechanism can be designed essentially as desired. Herein, in mechanisms operating by means of sensors are particularly preferred, in which the liquid product is automatically dispensed, for example, when the hand of a user approaches the soap dispenser or the dispensing nozzle for the liquid product. As sensors for example, motion detectors, infrared and/or heat sensors can be employed.

In addition, the locking and fastening device may be designed to connect the inner container and/or the outer container to the adaptor device or to lock the inner container inside of the assembled outer container. For example, the inner container can be inserted into the lower part of the outer container and the upper part of the outer container is guided onto the inner container from above. The locking and fastening device can preferably be used to fix the upper part of the outer container firmly on the lower part of the outer container so that the inner container is enclosed inside the two-part outer container. Fixation is preferably achieved by the interaction of the locking and fastening device with the adapter device.

Preferably, the lower part of the outer container itself can be firmly connected to the adapter device. For this purpose, the fixture may have suitable fastening means, or the lower part of the outer container may be fastened to the adapter fixture with a click or snap connection. It may also be preferred that the lower part of the outer container and the adaptor device are presently glued together.

The receiving body can be attached to the adapter device by means of the locking and fastening device. In the sense of the invention, this preferably means that the receiving body can be attached to the adapter device by means of the locking and fastening device. It is particularly preferred in the sense of the invention that the inner container and/or the outer container, which together form the receiving body, can be fastened to the adapter device with the locking and fastening device. Preferably, this means that by means of an interaction of the adapter device as wells as the locking and fastening device, the two-part outer container can firmly enclose an inner container, wherein the entire receiving body is held by the adapter device.

To achieve the attachment of the locking and fastening device to the adapter device, it may be preferred that the locking and fastening device comprises a first rail and a second rail, the rails having a curved end portion in their lower region. Preferably the adapter device comprises corresponding guides and a notch in which the curved end portions can engage. This allows the locking and fastening device to be guided up or down within the adapter device. The interaction between the curved end portions and the notch allows in particular for the locking and fastening device to snap into a lower position.

It is preferred in the sense of the invention that the rails in a fastened state are substantially parallel to each other and wherein the rails may be pressed apart in region of the curved end portions by means of an auxiliary tool in order to enable the locking and fastening device to be moved upwards and the inner container and/or the upper part of the outer container to be removed. The inner container is preferably removed from the lower part of the outer container. In addition, the upper part of the outer container may be removed and/or detached from the inner container, which in the sense of the invention is preferably also considered as removal.

After replacing the inner container, the inner container may be enclosed again inside the two-part outer container. To this end the inner container is firstly preferably positioned in the lower part of the outer container. The upper part of the outer container can now be placed on top of the inner container. Since the locking and fastening position is preferably in an upper position, this is readily possible. To enclose the inner container firmly inside the two-part outer container, the locking and fastening device is preferably moved downwards along said rails.

In an upper section, the locking and fastening device preferably exhibits a hollow cylinder section which may be pushed from above over the bottle neck of the inner container. When a lower position is reached, the hollow cylinder section preferably rests on the upper part of the outer area: The lower position preferably corresponds to the position in which the bent end sections snap into a notch of the adapter device. Thus, the locking and fastening device preferentially clamps the upper part firmly onto the lower part. The two-part outer container and the inner container positioned therein are firmly closed and fixed to the adapter device.

In a preferred embodiment of the invention, the adapter device comprises guides for guiding the rails or round bars. Thus, an upward or downward movement of the locking and fastening device as well as the removal of the inner container or the upper part of the outer container of the receiving body is considerably simplified, since the movement of the rails or round rods is guided.

The rails can, for example, be designed as metal or plastic rods, preferably with a substantially circular cross-section. Such bars are preferably also referred to as round bars in the sense of the invention. In this respect, it is preferred in the sense of the invention that the locking and fastening device comprises a first and a second round bar, the round bars each having curved end portions in their lower regions. Pressing the round bars apart preferably results in the locking and fastening device being able to be moved upwards so that the inner container and/or the upper part of the outer container can be removed from the soap dispenser, the inner container preferably being removed from the lower part of the outer container.

It is particularly preferred that the adapter device includes guides. It may further be preferred that the rails and/or the round bars can be guided up or down in the guides of the adapter device, whereby the curved end portions of the rails and/or the round bars can be pressed apart with the aid of the auxiliary tool. It is preferred in the sense of the invention that the fastened state is the state in which the receiving body with the locking and fastening device is fastened to the adapter device, while the term "replacement state" denotes the state in which the top of the outer container and/or the inner container can be removed from the soap dispenser or in which the inner container can be replaced, i.e. replaced by another inner container. It is preferred in the sense of the invention that the locking and fastening device in the fastened state is so arranged in the guides of the adapter device that the curved end portions of the first and second rails of the locking and fastening device embrace a widened projection of the adapter device and are thus held in a stable fastening state. Alternatively, it may also be preferred that the locking and fastening device in the fastened state is arranged in the guides of the adapter device in such a way that the curved end portions of the first and second round bars engage a widened projection of the adapter device and are thus held in a stable fastening state.

When fastened, the locking and fastening device cannot be moved further downwards in relation to the adapter device, so that only a movement upwards, preferably referred to as an upward movement in the sense of the invention, is possible. The spatial direction "downwards" is, in the sense of the invention, preferably directed towards a floor surface of the device or a base on which the soap dispenser may stand, whereas the spatial direction "upwards" is preferably directed in the opposite direction, i.e. away from the ground, whereby this spatial direction may point, for example, towards a nozzle of the proposed soap dispenser. The preferred upward movement allows the locking and fastening device to transit into an open state.

In other words, in a preferred embodiment of the invention, it is preferred that the device for dispensing a liquid product comprises the following components: an inner container for receiving the liquid product, an at least two-part outer container comprising an upper part and a lower part and adapted to receive the inner container, a locking and fastening device, the locking and fastening device comprising a first rail and a second rail, the rails having a curved end portion in their lower region, an adapter device, and a nozzle for dispensing the liquid product. It may be preferred that the locking and fastening device comprises a first and a second round bar, the round bars each having curved end portions in their lower regions.

The device according to this preferred embodiment of the invention is characterized in that the inner container and the outer container, or preferably its upper part, can be fastened to the adapter device by means of the locking and fastening device, wherein the rails or round rods run essentially parallel to one another in a fastened state and wherein the rails or round rods can be pressed apart in the region of the curved end portions by means of an auxiliary tool in order to enable the locking and fastening device to be moved upwards and the inner container and/or the upper part of the outer container to be removed.

An important advantage of the invention is that the proposed soap dispenser cannot be opened by unauthorized persons. For the purposes of the invention, the term "opening of the soap dispenser" is preferably to be understood to mean that it is possible to reach the interior of the inner container of the receiving body from outside the device. For example, in the opened state, new liquid product could be added to the inner container of the receptacle of the proposed soap dispenser. However, it is also possible that third parties introduce unwanted liquids or objects into the inner container. These could be, for example, body fluids, toxins, powdery material such as sand, or other objects that may be perceived as disgusting, poisonous and/or harmful to subsequent users of the soap dispenser, or that may damage or render the soap dispenser unusable. Such undesirable processes are preferably referred to as "manipulations" in the sense of the invention. As the receiving body can be attached to the adapter device with the locking and fastening device and the fastening can preferably only be released by using an auxiliary tool, the proposed invention provides a particularly tamper-proof soap dispenser. This is advantageously achieved also by the fact that the locking and fastening device can preferably only be moved upwards after using an auxiliary tool in order to enable the removal of the inner container and/or the upper part of the outer container.

A further particular advantage of the invention is that the proposed soap dispenser device does not require an enclosing cage to prevent the theft of the device. Such cages are often made of metal or have a metal look. In conventional soap dispensers from the hotel or tourism sector, they are used to attach soap dispensers to a wall or the rear wall of a wet room, for example in the area of a wash basin or shower. On the one hand, such metal cages, as known from the state of the art, are often not visually attractive. On the other hand, they leave the user of the soap dispenser, for example a hotel guest, an air traveler or a cruise ship tourist, with the impression of being considered a potential thief. As the invention obliviates the need for a metal cage for fastening the proposed soap dispenser, the user does not gain the impression of being regarded as a possible thief, but rather as a well-meaning hotel visitor or airline passenger. This can advantageously improve the user's well-being and aid in developing a positive attitude towards the provider of the hotel room, air travel or cruise. The proposed invention thus allows to provide a particularly theft-proof device which is visually attractive and does not brand users as a potential thieve. This is especially the case since the anti-theft mechanisms are essentially invisible or not recognizable as such, but are fluidly connected to the other components of the proposed soap dispenser or discretely result from the overall construction of the soap dispenser.

Further a method for replacing an inner container for containing a liquid product in a device for dispensing the liquid product or in a liquid product dispenser is proposed. It is preferred in the sense of the invention that the proposed method is performed with the proposed soap dispenser. However, it may also be preferable to apply the method to other devices provided that they contain the appropriate components. The proposed method comprises the following steps:

a) Removing a nozzle from a liquid product dispenser,
b) Releasing the locking and fastening device, preferably with an auxiliary tool, which may be a key or an integrated lever,
c) Upward movement of the locking and fastening device from a locked or fastened state by a height difference h, which allows firstly the upper part of the outer container to be pulled off the inner container and subsequently the inner container to be removed from the lower part of the outer container,
d) Inserting a new inner container in the lower part of the outer container,
e) Fixing the upper part of the outer container onto the new inner container,
f) Downward movement of the locking and fastening device to its locked or fastened state,
g) Placing the nozzle on the liquid product dispenser.

It may also be preferred in the sense of the invention that the inner container can be pulled off together with the upper part of the outer container and subsequently the inner container is are removed abruptly downwards from the upper part.

It is preferred in the sense of the invention that the soap dispenser exhibits a nozzle for dispensing the liquid product, the nozzle being removable from the device. Preferably, the nozzle is pulled off the soap dispenser in a first step in order to be able to replace the inner container of the soap dispenser's receiving body. It is preferred in the sense of the invention that unlocking the locking and fastening device is carried out using the auxiliary tool.

In this case, for example, the tip of the auxiliary tool may interact with a corresponding notch in the rear wall of the adapter device, so that when the auxiliary tool is inserted into the notch, the rails of the locking and fastening device are pressed apart and their curved end portions no longer engage in said notch. It is also preferable to move the locking and fastening device upwards from a fastened state for opening. Said upward movement may, for example, take place by a difference in height h, which advantageously allows the upper part of the outer container to be first removed from the inner container and subsequently the inner container to be removed from the lower part of the outer container. The inner container is preferably initially an empty inner container, i.e. a container which no longer contains any liquid product or only a residual quantity of the liquid product.

It is preferred in the sense of the invention that the soap dispenser comprises a viewing window to indicate the filling level. According to the invention, the inner container to be replaced is preferably referred to as a first inner container or an empty inner container, while the replacement or exchange container used in place of the first inner container in the soap dispenser is preferably referred to as second inner container, a full inner container or new inner container. It is preferred in the sense of the invention that the upper part of the outer container is attached to the new inner container after the inner container has been replaced, i.e. the first inner container has been replaced by a full, second inner container.

Preferably, the locking and fastening device can be returned to its original fastened or locked state by moving it downwards. This movement "downwards" is preferably referred to in the sense of the invention as a "downward movement of the locking and fastening device". Locking can be achieved, as described above, preferably by engaging curved end portions of the rails of the locking and fastening device with a notch of the adapter device. In this position the upper part is pressed firmly by the locking and fastening device (preferably by means of a locking ring or hollow cylinder adapted to this end) onto the lower part, which in turn is firmly connected to the adapter device. The proposed method is preferably completed by placing the nozzle back on the liquid product dispenser.

In a preferred embodiment of the invention, the device comprises a wall adapter, the wall adapter cooperating with the locking and fastening device of the device such that the device is attachable to a wall. It is preferred in the sense of the invention that this embodiment of the invention is referred to as a wall-mounted embodiment of the invention. The term "wall" is to be understood, for example, as a back wall behind a washbasin or as a side wall in a shower or back or side wall in the area of a bathtub in a hotel room. It may also be preferable in the sense of the invention that the term "wall" is used to designate a rear or side wall of an opening, for example a cuboid opening, in a rear or side wall of a bathroom in a hotel room or in a cruise ship, a public toilet or a toilet in an aircraft. The wall adaptor and/or the locking and fastening device of the soap dispenser may, for example, include openings for receiving fastening means for fastening the wall adaptor and the locking and fastening device together. Preferred fastening means include screws. The wall adaptor may also include holes for such fasteners to secure the soap dispenser to a wall. It may also be preferable, in the sense of the invention, that the attachment is made with a double-sided adhesive tape.

The wall adapter may, for example, be made of metal and/or plastic or include metal or plastic. The wall adapter can be in particular T-shaped. In terms of the invention, this means preferably that the wall adapter may comprise a plate with the aforementioned openings for the fastening means, which may, for example, be fastened to the wall with the fastening means. The transition area of the wall adapter to the receiving body, in particular to the outer container of the receiving body, can be formed by a transition element which is preferably less wide than the fastening plate of the wall adapter. This preferably results in a T-shape of the wall adapter. The T-shape of the wall adapter with a wider mounting plate and a narrower transition area enables on the one hand a stable mounting of the soap dispenser to the wall and on the other hand the provision of a visually appealing soap dispenser, in which a user may advantageously not see from the front how a mounting to the wall is technically implemented. Hence the user or viewer of the device has the impression of a visually appealing, high-quality and technically well thought out design.

In an alternative embodiment of the invention, the device comprises a cover for covering the locking and fastening device, and a base, the base being attachable to a lower portion of the locking and fastening device and allowing the device to be set up and/or fastened on a substrate. This alternative embodiment of the invention is preferably referred to as the table-top version of the invention. The substrate may, for example, be a washbasin or washstand in a bathroom in a hotel or on a cruise ship or a washbasin or washstand in an aircraft or public toilet. The provision of the cover to cover the locking and fastening device is combined with the advantage that a rear wall of the soap dispenser is covered, whereby in the area of the rear wall, in particular, the locking and fastening device of the soap dispenser is located. By covering the locking and fastening device invisibly for the user, the user or viewer of the soap dispenser is also given a visually appealing, high-quality and technically sophisticated impression with regard to the soap dispenser design. In terms of the invention, it is preferred to refer to the area of the rear of the proposed soap dispenser as a "tunnel". The rear being the backside where the cover or wall adapter is provided, the cover or wall adapter preferably interacting with the locking and fastening device of the soap dispenser.

The base of the soap dispenser may preferably be attached to a lower part of the adaptor device, although this lower part of the adaptor device may preferably include a platform as described below. For example, the base and platform of the adaptor device may interact with each other so that the platform is recessed in the base. It may be in the sense of the invention that the base and the platform are connected to each other by fastening means, which may for example be a screw. It may also be preferred in the sense of the invention that the base and platform are glued together. The base is advantageously used to enable the soap dispenser to be set up and/or installed on a ground or substrate.

It is preferred in the sense of the invention that the base is adapted in such a way that an axis passing through the device encloses an angle of inclination with a plane formed by the ground or substrate, the angle of inclination being less than 90°. In the sense of the invention, this preferably means that the soap dispenser, in the fastened state, is fixed obliquely to the base. If, in the mounted state of the soap dispenser, after using the soap dispenser, a drop of the liquid product gets stuck at the outlet of the nozzle, this drop does not run down and contaminate the soap dispenser or its elements. Instead the drop may drip down to the ground or substrate, where it can be more easily removed by cleaning or housekeeping personnel. The angle of inclination can be achieved, for example, by having the base include a ramp-shaped plane on which the platform of the adapter device is fixed. It is preferred in the sense of the invention that the base comprises the ramp-shaped plane in an upper portion of the base, said upper portion of the base preferably facing the locking and fastening device or the platform of the adapter device. The preferably inclined attachment of the soap dispenser to the base thus contributes significantly to the advantage that the soap dispenser can be cleaned particularly easily and without effort. The embodiment moreover effectively prevents contamination which could lead to a reduction in hygiene. In addition, the high-quality, visually appealing impression of the soap dispenser is underlined.

In a preferred embodiment, the device may include an intermediate adapter which provides a connection between the base and the lower part of the adapter device. The soap dispenser can be installed on any base by providing an intermediate adapter. This is particularly advantageous for retrofitting pre-installed bases with the soap dispenser of the invention. It is not necessary to change the adapter device or the soap dispenser's receiving body to adapt it to the pre-installed base. Instead, an intermediate adapter can be provided, the upper side is designed to match the lower part of the adapter device and its lower side is designed to match the respective base.

This allows the fixture to be produced identically and to be mounted to the respective types of pre-installed bases using individualized intermediate adapters.

It is preferred in the sense of the invention that an upper part of the locking and fastening device comprises a lid. The lid may preferably comprise aluminum or be formed of aluminum. It may also be preferred in the sense of the invention that the lid is formed of or comprises a plastic material. In this case it may be preferred that the lid has an aluminum or metal appearance. In particular, the lid may be located in the area of an upper, preferably hollow cylinder-like area of a transition region of the locking and fastening device or may enclose the latter.

The transition area of the locking and fastening device comprises a short vertical piece, the ring and a hollow cylinder, the height of which is substantially correlated with the height of the lid. It is preferred in the sense of the invention that the hollow cylinder has a slightly smaller outer diameter compared to the inner diameter of the lid, so that the lid can be slid over the hollow cylinder section of the transition area of the locking and fastening device. It is preferred in the sense of the invention that the transition area is formed of or comprises a plastic material. It is particularly preferred in the sense of the invention that the soap dispenser comprises three superimposed layers of material in the region of the lid, namely preferably the outer lid, which preferably comprises aluminum or is formed therefrom, including the hollow cylinder of the transition region and including a further plastic element surrounding an external thread of the inner container, the external thread being formed in the upper region of the inner container like the external thread of a conventional bottle. The external thread is preferably designed to cooperate with the internal thread of the plastic element in order to close the inner container or to fix in the opening of the inner container a dispensing device which may for example comprise a nozzle or a spout and with which the liquid product can be dispensed to a user, preferably in portions.

It is preferred in the sense of the invention that the locking and fastening device comprises a ring, the ring having a visible height of 0.5 mm to 20 mm, preferably of 1 mm to 10 mm and particularly preferably of 2 mm. The ring is preferably part of the transition area between the locking and fastening device and the lid and can advantageously be contrasted in color with the other components of the locking and fastening device and/or the proposed soap dispenser. In particular, the ring is part of a transition area between the central area and the locking and fastening device and the separate lid. The transition area preferably comprises a short vertical piece, the ring and a hollow cylinder. It is preferred in the sense of the invention that in the transition area, in particular the ring and the vertical piece are visible, whereas the hollow cylinder is not visible in the assembled state of the soap dispenser. Preferably the vertical piece is located between the central area and the ring.

It is preferred in the sense of the invention that the upper portion of the locking and fastening device comprising the lid exhibits a diameter of 2 cm to 5 cm, preferably 3 cm to 4 cm, particularly preferably 3.4 cm to 3.8 cm and most preferably 3.6 cm. This upper part of the locking and fastening device is preferably called "with the lid". A preferred height of 3.6 cm has proved to be visually particularly attractive, this width corresponding in particular to the diameter of a platform, which is preferably part of the adapter device.

It is preferred in the sense of the invention that the locking and fastening device comprises a central portion or piece which is integrated into a surface of the upper part of the outer container. It is particularly preferred that the central portion is present in the region of the upper part of the outer container, where the bottle neck begins or where the outer container tapers to merge into a bottle neck. The preferred integrated presence of the central portion in the surface of the outer container is advantageous in that it creates a haptically appealing impression. In addition, it is particularly hygienic, since protrusions, corners or edges are avoided in which bacteria or residues of the liquid product may reside or accumulate. In addition, a soap dispenser, where the central portion of the locking and fastening device is integrated in the surface of the outer container, may be cleaned with particular ease and without effort, thus facilitating the work of housekeeping staff.

In a preferred embodiment of the invention, the lower part of the outer container exhibits openings. Advantageously, when the inner container is inserted into the lower part of the outer container, the air displaced in the process can escape more easily, so that the insertion of the inner container may be facilitated. It is preferred in the sense of the invention to refer to the openings as air holes.

It is preferred in the sense of the invention that the device comprises a viewing window for indicating the filling level. Preferably the window is provided in the lower part of the outer container, the inner container being transparent at least in the area of the window so that a user may inspect the level of the liquid product inside the inner container. It is also preferred that the window be in close proximity to a bottom surface of the inner container so that the level of the liquid product inside the inner container may be determined with particular accuracy and so that the inner container is not replaced prematurely, when significant quantities of liquid product are left in the inner container. The window may preferably exhibit the shape of an elongated rectangle with rounded corners, the longer sides of the rectangle preferably being substantially parallel to an axis passing through the center of the containers and the short sides of the rectangle being substantially perpendicular to said central axes of the containers. The embodiment of a viewing window as an elongated rectangle with rounded corners may preferably also be referred to as an elliptical configuration of the viewing window for the purposes of the invention, if said longer vertical edges of the window are not entirely parallel.

It is preferred in the sense of the invention that the window is preferably located substantially directly above the bottom surface of the inner container, whereby the term "substantially directly" is not unclear to the skilled person, because the person skilled in the art knows that the term may mean, that a distance between a short side of the preferably rectangular window and the bottom surface of the inner container is not greater than 1 cm, preferably not greater than 0.5 cm and more preferably not greater than 0.3 mm. In other words, for the purposes of the invention, it is preferred that the distance between a short side of the preferably rectangular window and the bottom surface of the inner container is less than 1 cm, preferably less than 0.5 cm and more preferably less than 0.3 cm. It is particularly preferred in the sense of the invention that the window is located above a bottom bend of the inner container. In the sense of the invention, the term "bottom bend" preferably refers to a lower rounded outer edge of the inner container of the device.

Preferably, the inner and/or outer container of the receiving body exhibit an essentially circular shape in cross section. It is particularly preferred in the sense of the invention that the bottom surfaces of the inner and/or the outer container have substantially circular shapes. It may also be preferred in the sense of the invention that the inner and/or the outer container are flat in the area of a rear wall, whereby the flat design of the rear wall is preferably also referred to as "flattened" design of the rear wall in the sense of the invention. The rear wall of the container is preferably the side of the container which faces the locking and fastening device. In the embodiment of the invention, which can be fastened to a wall, the rear or back wall of the containers or the device is preferably the side of the container which faces the wall.

It is preferred in the sense of the invention that the adapter device comprises in a lower region a platform having a substantially circular base area. Preferably the platform has a visible height of 1 mm to 12 mm, preferably of 3 mm to 9 mm, particularly preferably of 5 mm to 7 mm and most preferably of 6 mm. Furthermore, the platform may have a diameter in the range of 2 cm to 5 cm, preferably 3 cm to 4 cm, particularly preferably 3.4 cm to 3.8 cm and most preferably 3.6 cm. It may be preferred in the sense of the invention that the platform of the adapter device interacts with the base for mounting the so-called "table top mounted" version of the invention in such a way that the platform is recessed in the base. It may be preferred in the sense of the invention that the base and the platform are connected to each other with fastening means, wherein said fastening means may be a screw or a threaded connection, for example. In terms of the invention, it may also be preferred that the base and the platform are glued together. It is particularly preferred in the sense of the invention that the table or the base on which the proposed soap dispenser is to be mounted in said embodiment of the invention exhibits an internal thread, whereas an external thread which can cooperate with the internal thread can be located in the lower part of the outer container or in the platform of the adapter device. In this case, the connection between the soap dispenser and the base is effected by a screw connection.

Said embodiment of the invention is particularly preferred because the proposed invention thus differs substantially from the known prior art, in which the soap bottle usually exhibits an opening at the bottom and, in the area of the lower bottle neck, an external thread which interacts with an internal thread of a table adapter. However, this internal thread of a table adapter often forms a collecting container for soap residues and contaminations, which are difficult to clean. In the embodiment in which the table or the base on which the proposed soap dispenser is to be placed has an internal thread which interacts with an external thread on the lower part of the outer container of the receiving body, such a collection of soap residues or contaminations is precisely avoided, so that the proposed invention is particularly hygienic and can be used with little cleaning effort. It is particularly preferred that the proposed soap dispenser of the present invention is designed reversed or opposite to the conventional soap dispensers known from the prior art with regard to the design of the external and internal threads. The embodiment of the invention described herein is particularly suitable for use in aircraft or coaches.

It is preferred in the sense of the invention that the dimensions of the inner container correspond to the dimensions of the upper part and/or the lower part of the outer container in such a way that the inner container can be inserted with particular ease into the lower part of the outer container. In doing so, the insertion of the inner container into the lower part of the outer container through the openings in the lower part of the outer container is substantially facilitated because the air displaced by the inner container can be expelled more quickly from the area of the lower part of the outer container. In particular, the air does not have to escape exclusively laterally through gaps between the inner and outer containers, but can advantageously escape through said openings, which may be referred to as air holes.

It is particularly preferred in the sense of the invention that the height of the visible lower part of the soap dispenser is substantially equal to one quarter of the total height of the soap dispenser, while the visible part of the upper part of the outer container until it tapers is substantially equal to approximately 50% of the total height of the soap dispenser. Said dimensions create visually appealing proportions and the center of gravity of the soap dispenser can advantageously be adjusted in such a manner that an undesirable tipping over of the soap dispenser is effectively prevented.

Preferably, the proposed soap dispenser comprises a nozzle for dispensing the liquid product, wherein the nozzle can be pulled off the device. It may also be preferred in the sense of the invention that the device includes a pump mechanism by which the liquid product can be pumped from the inner container into the nozzle. To this end the device may comprise a tube or hose-like device which extends into the liquid product and through which the liquid product can be conveyed to an upper portion of the device, where the liquid product is delivered to a user through said nozzle.

It is preferred in the sense of the invention that the lower part of the outer container comprises openings for dispensing a fragrance, wherein the fragrance is present in the lower part of the outer container. Said embodiment of the invention is particularly advantageous when the soap dispenser is not only intended to dispense a liquid product but furthermore improve upon the air or the aesthetic perception of the air in a room, in which the soap dispenser is placed. It may be preferred in the sense of the invention that a pad made of cotton wool or cellulose soaked with a fragrance is inserted into the lower part of the outer container, for example, so that the fragrance is released to the external environment through said openings provided for this purpose in the lower part of the outer container. In preferred embodiments, a fragrance ring may be inserted, which can be easily and quickly replaced depending on the desired scent. Alternatively, however, it may also be preferred to fill a liquid fragrance directly into the lower part of the outer container. Preferably, the fragrance may be renewed regularly. When replacing the fragrance, it is possible to vary between fragrances that differ, for example, in their tendency of scent. For example, different fragrances can be used in summer compared to winter.

It is preferred in the sense of the invention that the openings may be elliptical, circular, slit-shaped and/or elongated, wherein any other shapes are likewise conceivable, as long as they allow, on the one hand, a sufficiently high mechanical stability of the lower part of the outer container and, on the other hand, for the fragrance to escape from the outer container. In terms of the invention, it may also be preferred that the openings are in the form of a customer's logo or represent a logo or parts thereof. Furthermore, the openings may be evenly or irregularly distributed on the bottom surface of the lower part of the outer container.

In a further aspect, the invention relates to a kit for replacing an inner container for receiving a liquid product in a liquid product dispenser, comprising a liquid product dispenser and an auxiliary tool for releasing a locking and fastening device of the liquid product dispenser. The definitions, technical effects and surprising advantages described for the soap dispenser apply analogously to the kit, and vice versa. It is preferred in the sense of the invention that the unlocking of the locking and fastening device is carried out using the auxiliary tool so as to allow the upward movement of the locking and fastening device and the removal of the inner container and/or the upper part of the outer container. The inner container can subsequently be removed from the lower part of the outer container. The upper part of the outer container may also be removed and/or detached from the inner container. In particular, an authorized person may use the auxiliary tool to transfer the soap dispenser from a locked state to a replacement state, the term "replacement state" preferably denoting the state in which the upper part of the outer container and/or the inner container may be removed from the soap dispenser or the inner empty container may be replaced by a new, full container for the liquid product. The transition from the locked state to a replacement state is achieved in particular by pressing the curved end portions of the rails and/or the round bars of the closing and fixing device apart with the aid of the auxiliary tool so as to allow the top of the outer container and/or the inner container to be removed.

Figure 7:
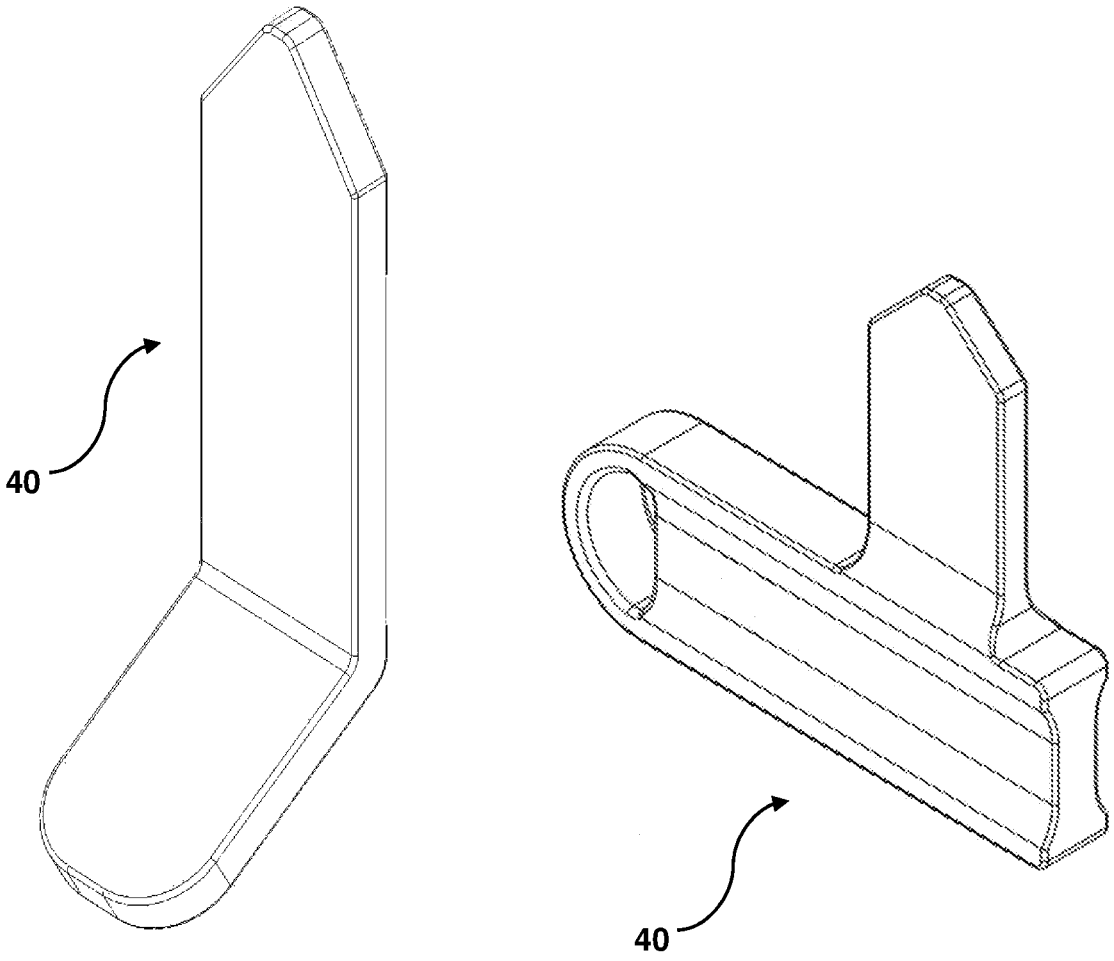

It is preferred in the sense of the invention that the locking and fastening device in the locked state is presently arranged in the guides of the adapter device in such a way that the curved end portions of the first and second rails of the locking and fastening device embrace a widened projection of the adapter device and are thus held in a stable fastening or locking state. The locked state is in particular characterized in that the rails and/or round bars run essentially parallel to one another, preferably in the said guides of the adapter device. The auxiliary tool is preferably shaped and designed in such a manner that it may be used to press the rails and/or round rods of the locking and fastening device apart. An example of an auxiliary tool is shown in FIG. 7, in particular the tip of the tool may cooperate with a corresponding notch in the rear wall of the adaptor device, so that the insertion of the auxiliary tool into the notch will release the ends of the rails and/or the round bars of the locking and fastening device. Preferably, the shape of the notch corresponds to the shape of the auxiliary tool, in particular the section of the auxiliary tool which is inserted into the adapter device. For example, if the auxiliary tool is shaped like an arrowhead, the notch in the rear wall of the adaptor device may be shaped like an inward pointing arrow. Such a configuration of the rear wall of the adaptor device is shown in FIG. 1. It is particularly preferred in the sense of the invention that the attachment of the locking and fastening device to the adapter device can only be released by using said auxiliary tool. Thus, only authorized personnel in possession of an auxiliary tool can replace the inner container for the liquid product. As a result a particularly tamper-proof kit may be provided, for which not arbitrary persons may replace the soap container.

The further dependent and the description below provide further advantages, features and details of the invention. The features mentioned therein may individually contribute to the invention or in any combination. As such the disclosure is intended to refer mutually to the individual aspects of the invention. The drawings serve as examples only to clarify the invention without intending to be limiting.

The invention is described in more detail by means of the following figures; the figures showing:

FIG. 1 Illustration of a preferred embodiment of an adapter device

Figure 2:
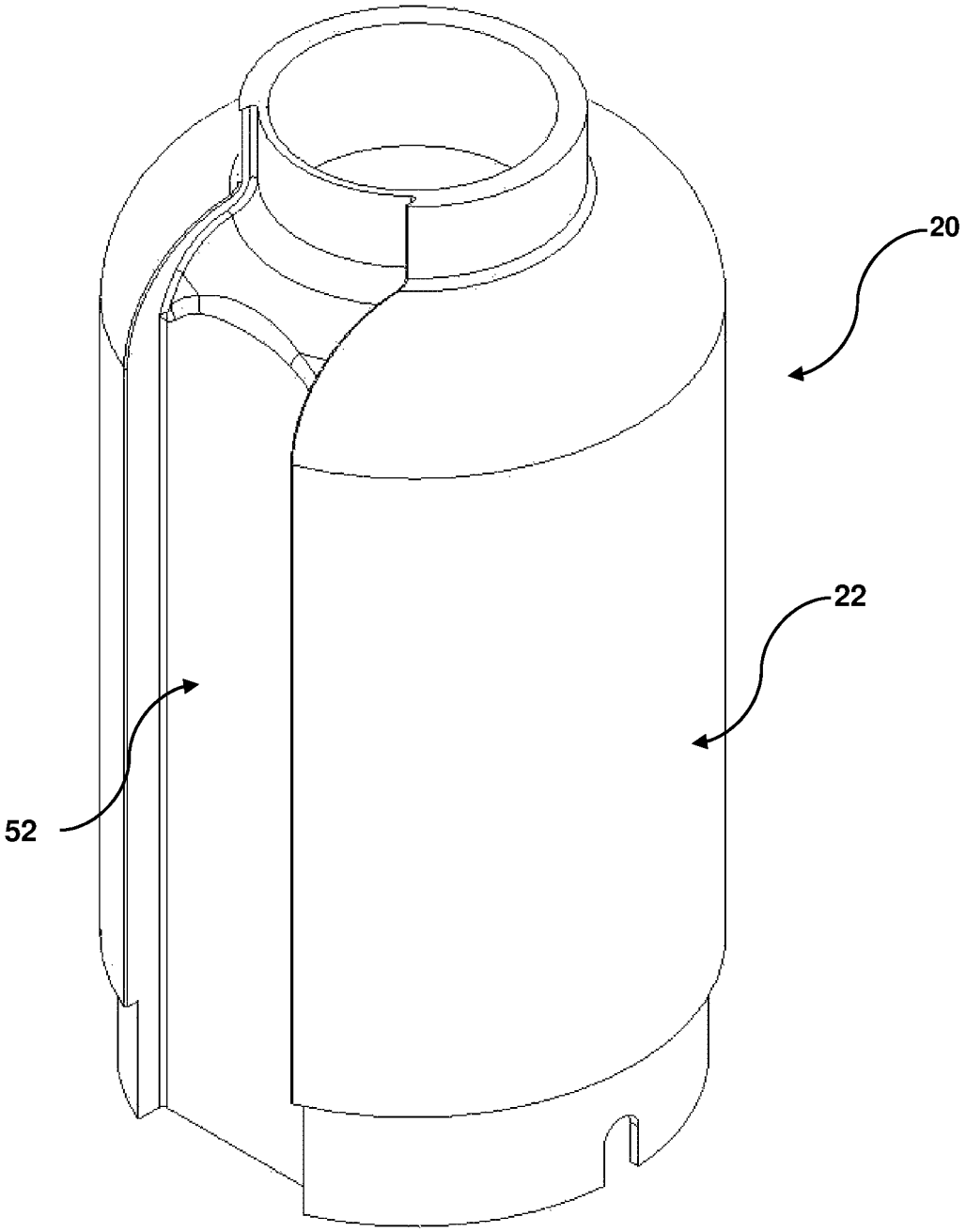
Figure 3:
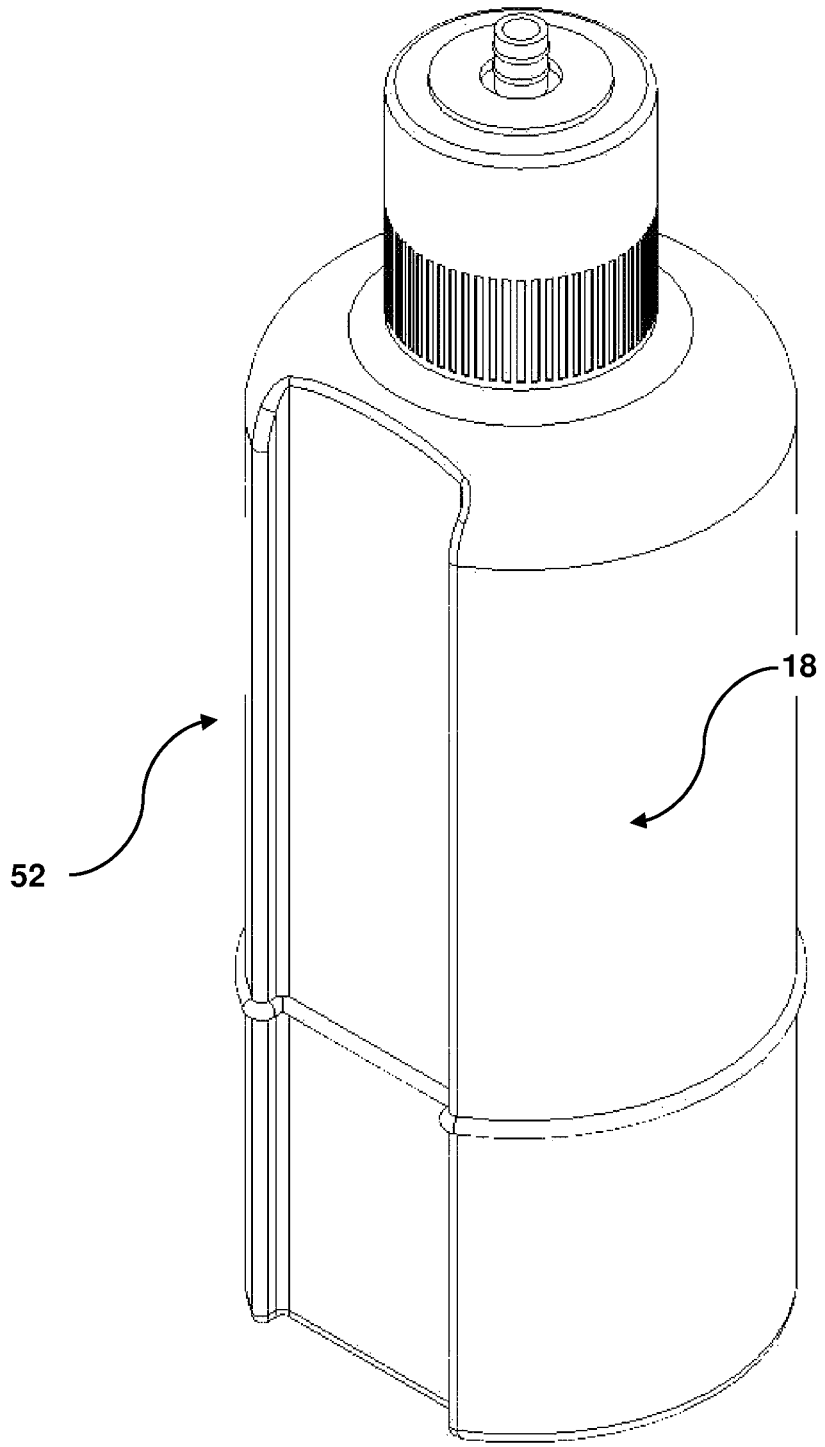
Figure 4:
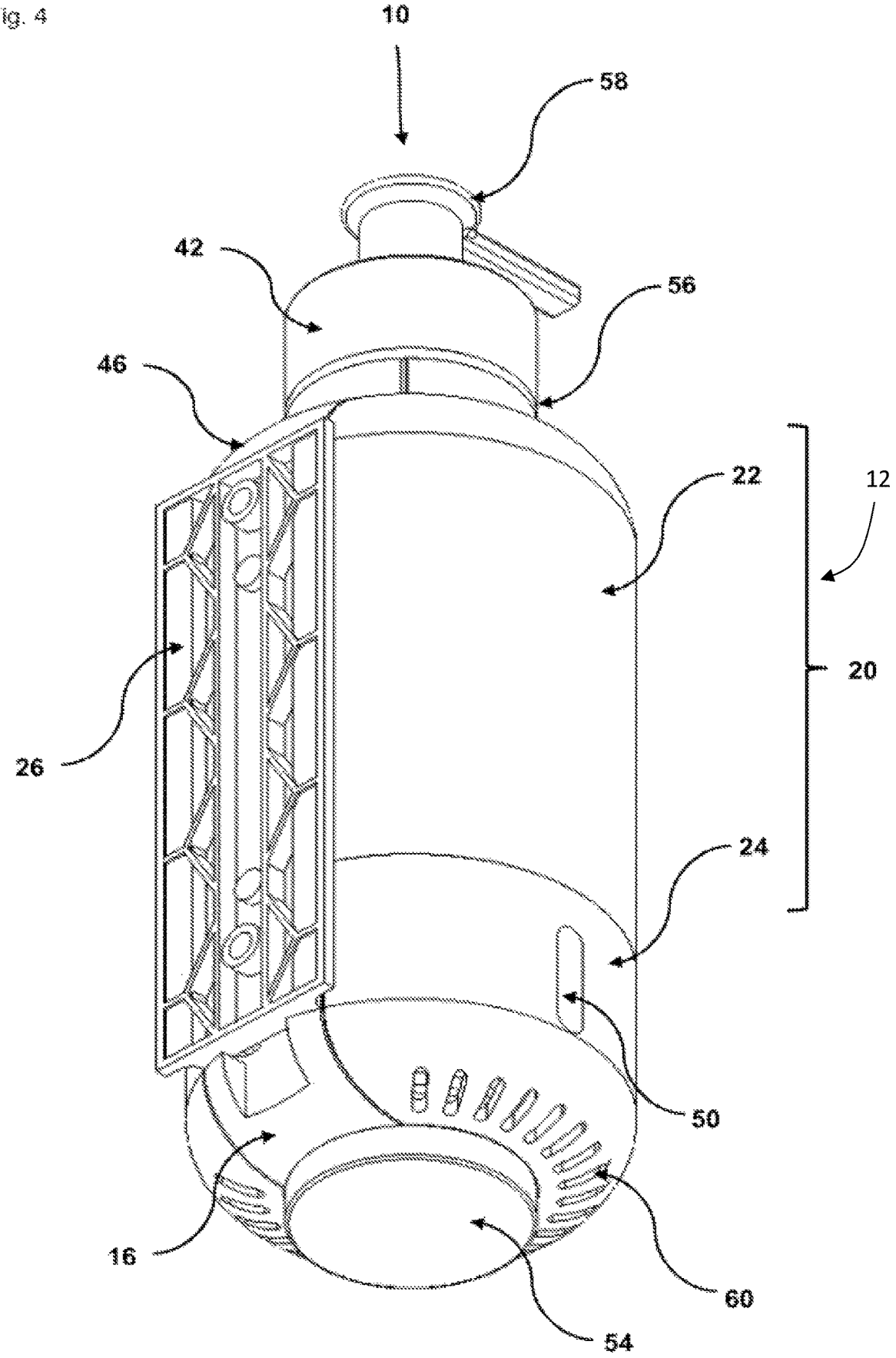
Figure 5:
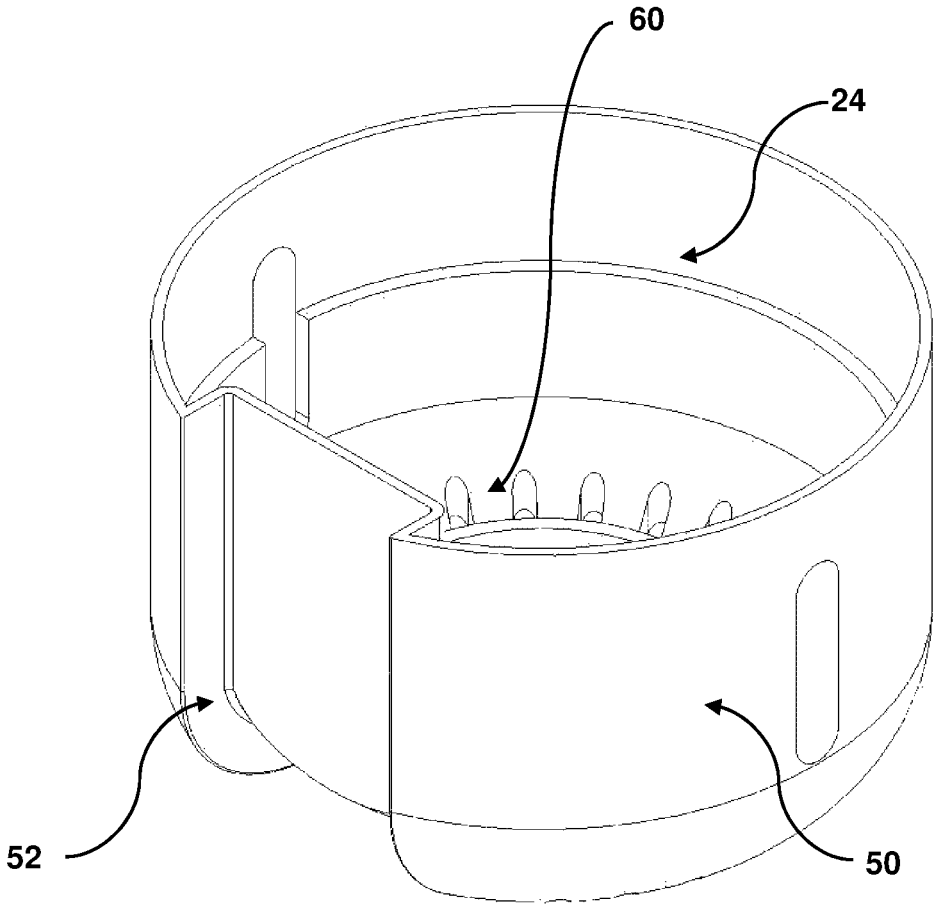
Figure 6:
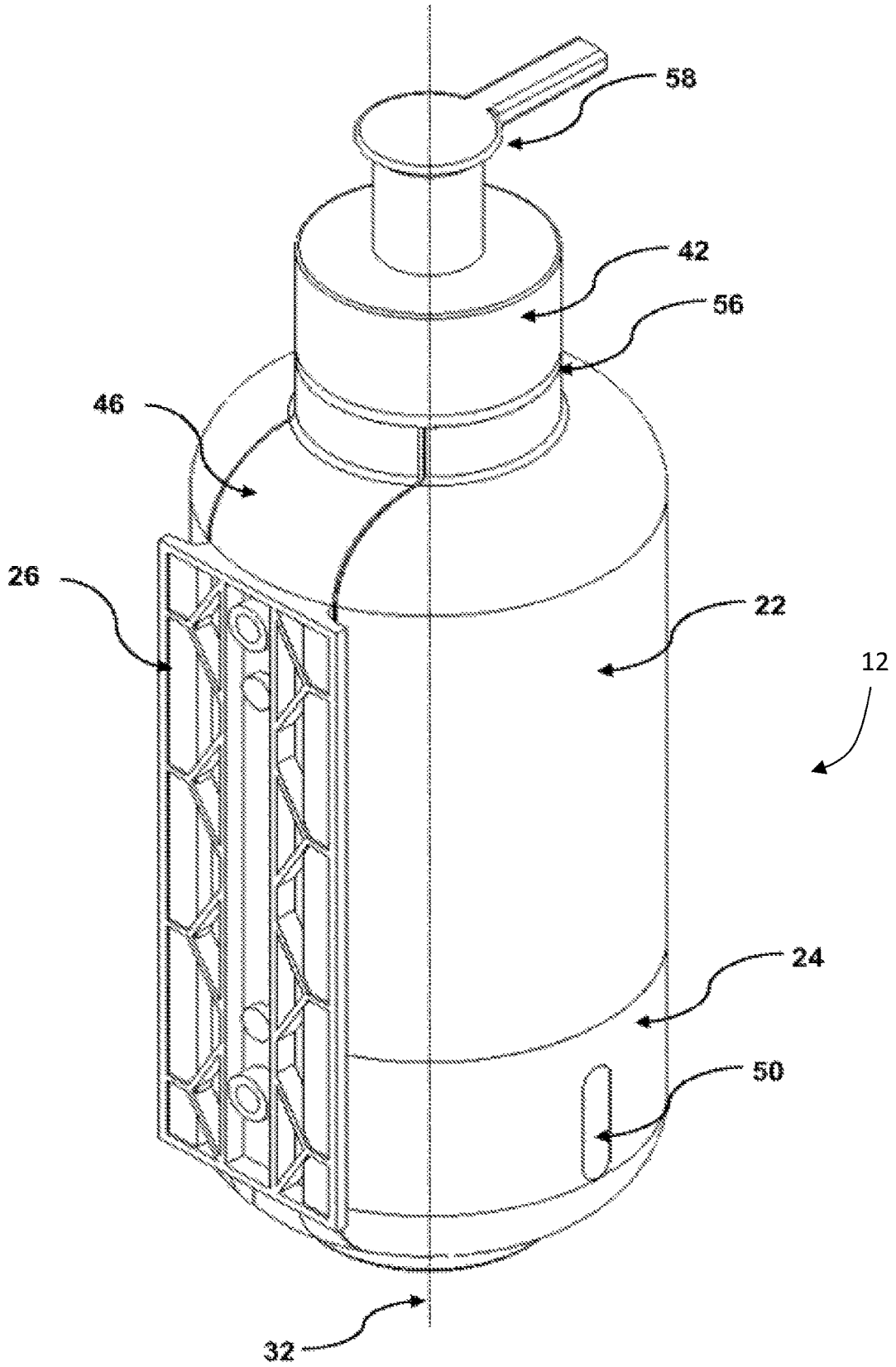
Figure 8:
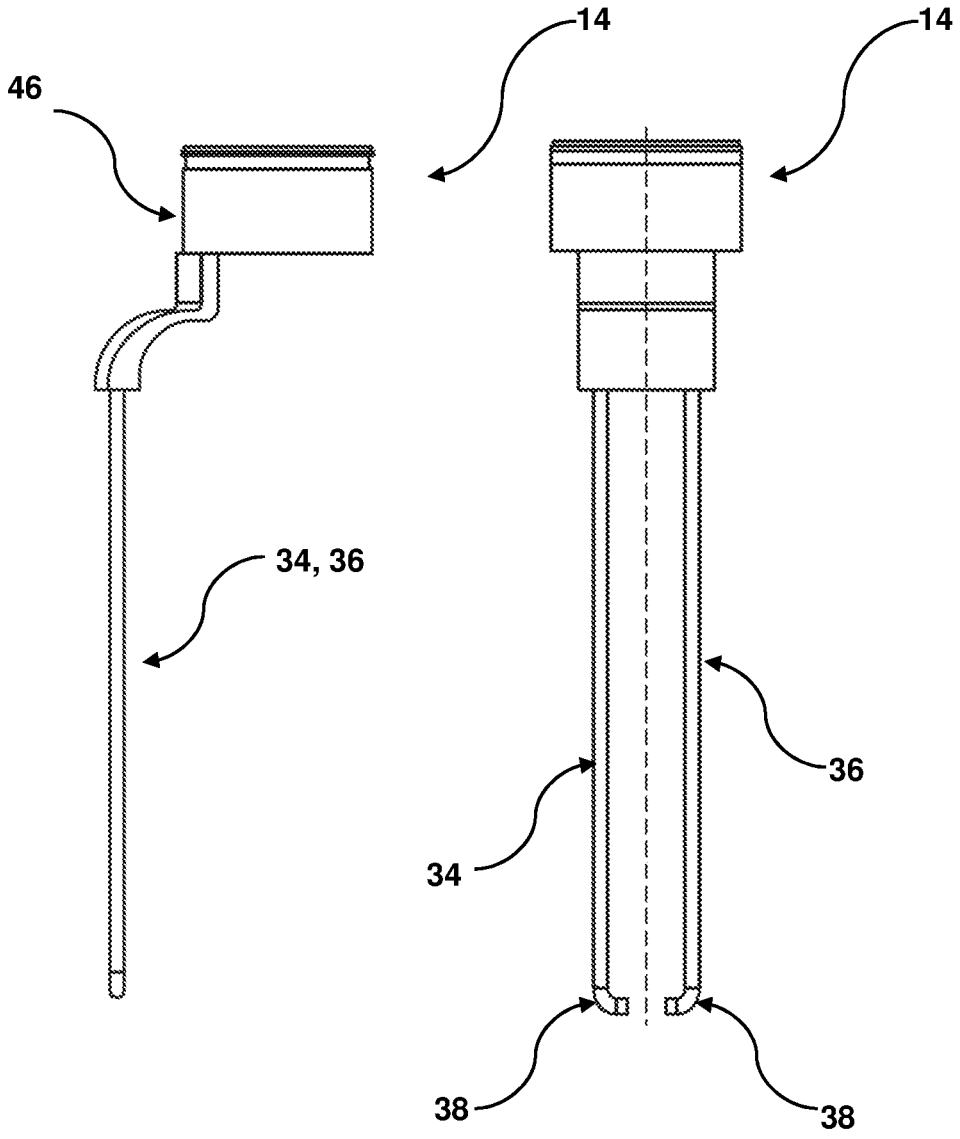
Figure 9:
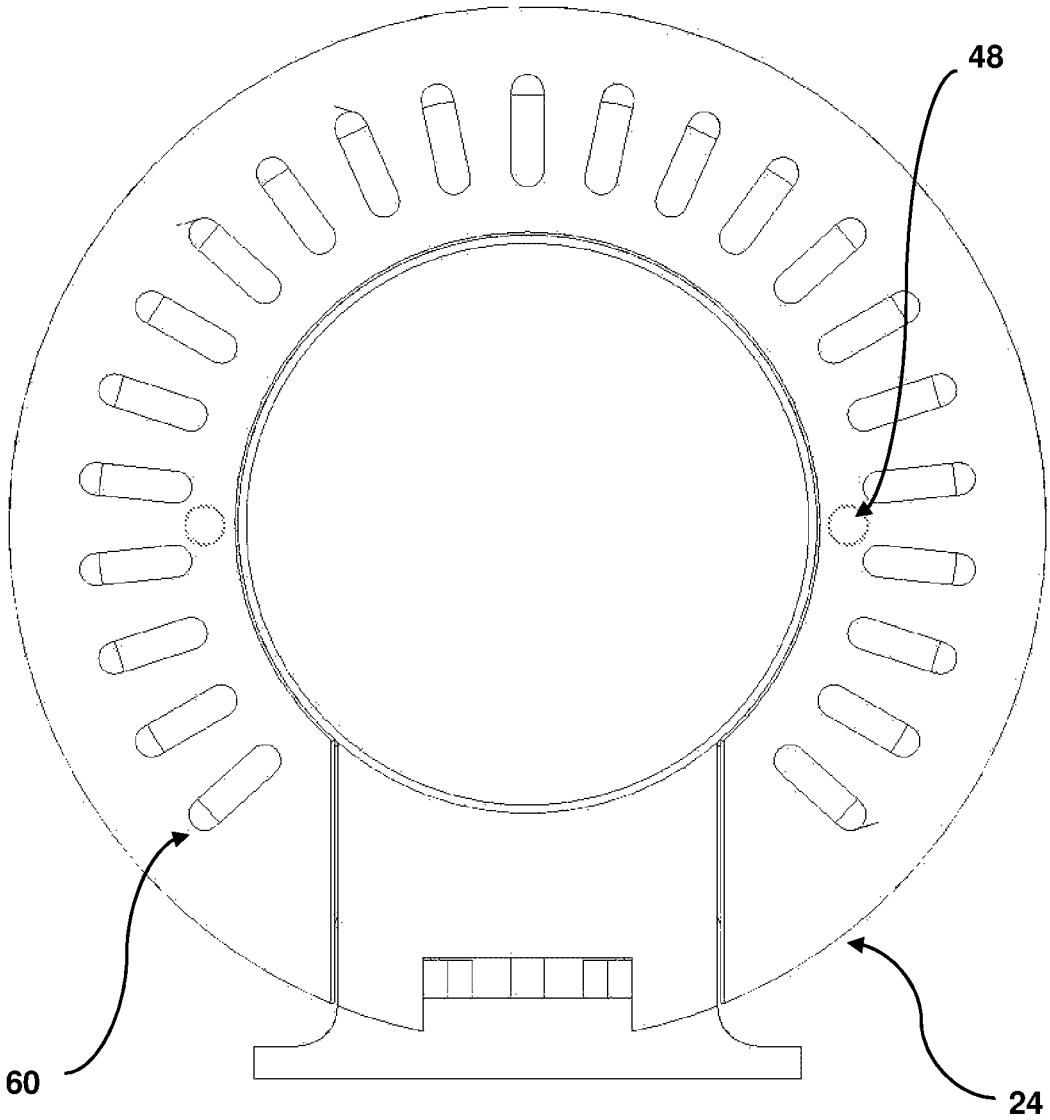

FIG. 2 Illustration of a preferred embodiment of an upper part of the outer container FIG. 3 Illustration of a preferred embodiment of an inner container FIG. 4 Illustration a preferred embodiment of the invention for mounting the dispenser on a wall FIG. 5 Illustration of a preferred embodiment of a lower part of the outer container FIG. 6 Illustration of a preferred embodiment of the invention for mounting the dispenser on a wall FIG. 7 Illustration of a preferred embodiment of the auxiliary device FIG. 8 Illustration of a preferred embodiment of a locking and fastening device FIG. 9 Illustration of a preferred embodiment of a lower part of the outer container FIG. 1 depicts the preferred embodiment of an adapter device (16), wherein the receiving body (12) of the device (10) can be attached to the adapter device (16) by means of the locking and fastening device (14).

FIG. 2 depicts the preferred embodiment of an upper part (22) of the outer container (20). In particular, FIG. 2 also shows a rear wall (52) of the upper part (22) of the outer container (20), which may be flattened, for example. FIG. 2 shows the preferred embodiment of an inner container (18), the rear wall of which is shaped to exactly fit to the rear wall of the upper part (22) of the outer container (20).

FIGS. 4 and 6 depict preferred embodiments of a soap dispenser (10) that can be mounted on a wall (wall mounted dispenser). The preferred embodiment of the soap dispenser (10) includes a wall adapter (26) with which the soap dispenser (10) can be mounted on a wall. For this purpose, the wall adapter (26) is preferably attached to the adapter device (16) of the soap dispenser (10), so that the wall adapter (26) is preferably arranged between the wall and the soap dispenser (10) when the soap dispenser (10) is attached to said wall. FIGS. 4 and 6 depict the soap dispenser (10) with its outer container (20), which is formed by an upper part (22) and a lower part (24). The lower part (24) may have openings (60) for dispensing a fragrance and openings (not shown) for the faster escape of air. These openings (48) facilitate the insertion of an inner container (18) into the base (24) of the outer container (20). Furthermore, the lower part (24) of the outer container (20) may comprise a window (50) through which the level of the inner container (18), which preferably contains the liquid product, may be inspected. The window (50) allows to determine the level of the liquid product in the inner container with particular ease.

The lower part (24) of the outer container (20) is preferably fixedly connected to the adapter device (16) of the soap dispenser (10), wherein the adapter device (16) may comprise a platform (54) in a lower area. In the depicted closed or locked state, there is a locking and fastening device (14) inserted in the adapter device (16), wherein a fastening can be mediated as shown in FIGS. 1 and 8 by engaging rails with curved end portions in a notch of the adapter device.

In an upper region, the locking and fastening device (14) comprises a central piece (46) or a central portion (46), respectively, and a ring (56) which may be contrasted in color with the other components of the soap dispenser (10). The uppermost region of the locking and fastening device (14), which is preferably formed by a non-visible hollow cylinder, is surrounded by a lid (42). The inner diameter of the hollow cylinder is preferably selected such that it can enclose an upper bottle neck of the inner container (18) and thus firmly encloses the inner container (18) inside the outer container (20). The upper end of the soap dispenser (10) is formed by the nozzle (58) with which the liquid product is dispensed to a user. The device (10) preferably includes a suitable pumping mechanism for this purpose. It is preferred in the sense of the invention that the soap dispenser (10) comprises a receiving body (12), the receiving body (12) comprising the inner container (18) and the outer container (20). The outer container (20) in turn preferably comprises an upper part (22) and a lower part (24), wherein the inner container (18), in which the liquid product is located, is arranged in the interior of the outer container (20). In the illustrated locked or closed state, the inner container (18) is located in the lower part (24) of the outer container (20). From above, the inner container (18) is enclosed by an upper part (22), which in turn is held from above by the locking and fastening device (14).

FIG. 5 depicts the preferred embodiment of a lower part (24) of the outer container (20), in particular its rear wall (52), the window (50) for inspecting the filling level, and various openings (48, 60). There are preferably openings (60) for dispensing a fragrance and/or air holes (48) which facilitate the escape of air when the inner container (18) is inserted into the outer container (20).

FIG. 6 furthermore depicts a virtual central axis (32), which preferably extends centrally through the soap dispenser (10).

FIG. 7 depicts two preferred embodiments of an auxiliary tool (40) with which an authorized person can move the soap dispenser (10) from a locked state to a replacement state. The auxiliary tool (40) preferably forms a kit with the soap dispenser (10). The upper part of the auxiliary tool (40) is preferably arrow-shaped so that this tip can be inserted into a notch (62, see FIG. 1) of the adapter device (16). The movement presses the two rails (34, 36, see FIG. 8) of the locking and fastening device (14) apart so that the top (22) of the outer container (20) and subsequently the inner container (18) can be removed from the soap dispenser (10) and the lower part (24) of the outer container respectively.

On the left, a preferred embodiment of the auxiliary tool (40) is illustrated with an essentially elongated handle. Such an auxiliary tool is particularly suitable for applications where the device (10) is freely standing or fixed to a wall. If the device is installed by means of a base on a ground or substrate (e.g. a wash basin), the elongated handle may be unwieldy. As illustrated on the right, it may be preferable instead to use an auxiliary tool (40) whose handle is perpendicular to the orientation of the tip. This allows a particularly good accessibility and quick opening in confined spaces.

FIG. 8 depicts the preferred embodiment of a locking and fastening device (14), wherein the rails (34, 36) of the locking and fastening device (14) may have curved end portions (38) at their lower ends, which can be pushed apart by the use of an auxiliary tool (40). In the fastened or locked state, the rails (34, 36) are preferably presently arranged in guides (44, see FIG. 1) of the adapter device (16), wherein the curved end portions (38) engage in the notch (62) of the adapter device (16) (see FIG. 1).

The locking and fastening device (14) also comprises a central piece (46) which preferably fits smoothly, i.e. at the same level, into the surface of the upper part (24) of the outer container (20). The rails (34, 36) of the locking and fastening device (14) are preferably substantially parallel, particularly when fastened. By pressing them apart with the aid of the auxiliary tool (40), the rails (34, 36) can be temporarily non-parallel. It is preferred in the sense of the invention that the rails (34, 36) are sufficiently elastic to this end.

FIG. 9 depicts the preferred embodiment of a lower part (24) of the outer container (20) with air holes (48) and openings (60) for dispensing a fragrance.

Figure 10:
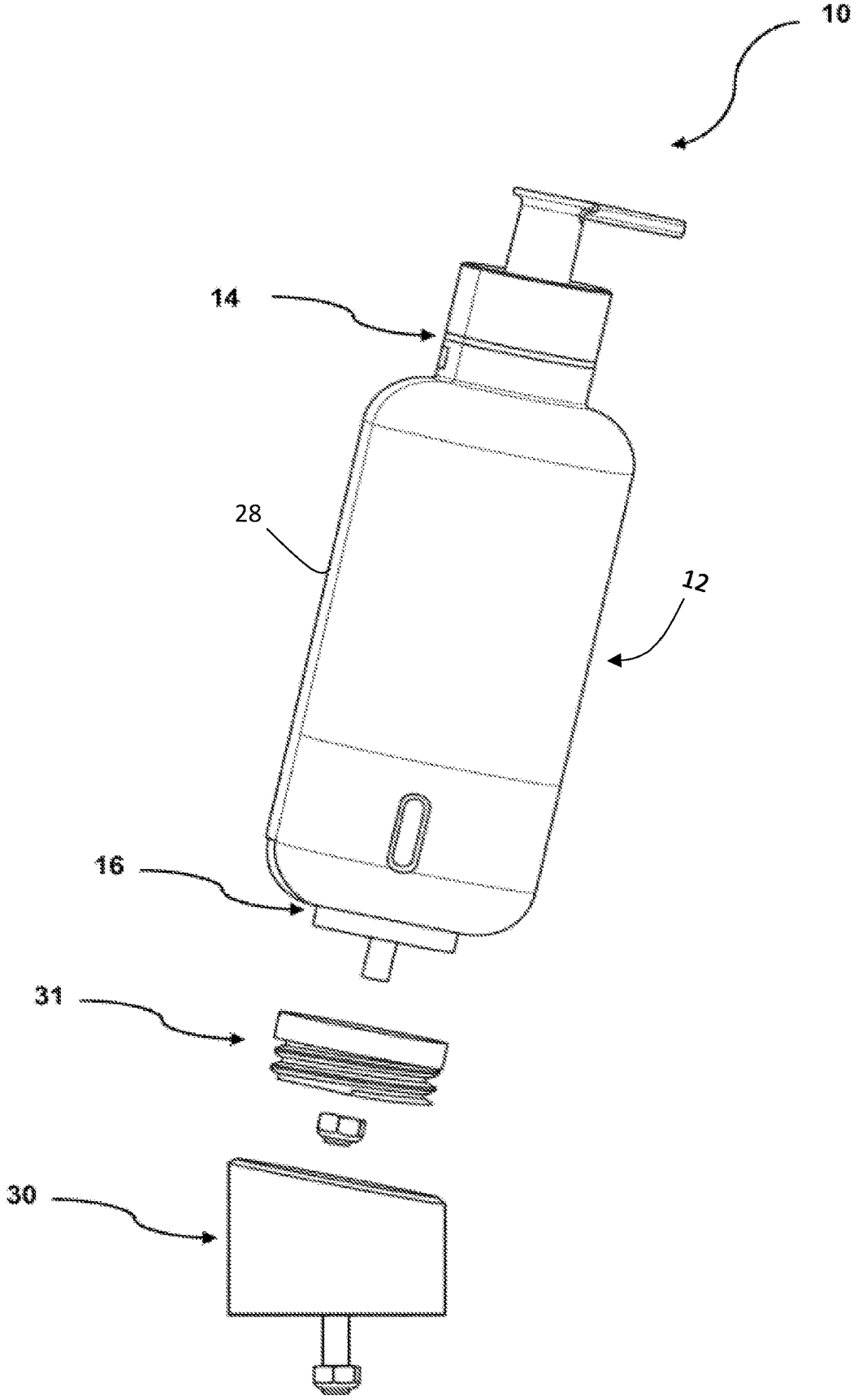

FIG. 10 illustrates a preferred embodiment in which the device (10) comprises an intermediate adapter (31) which provides a connection between the base (30) and the lower part of the adapter device (16). In particular, by providing an intermediate adapter (31) adapted to a respective base (30), retrofitting of the device (10) on pre-installed bases (30) may be carried out simply and cost-effectively.

LIST OF REFERENCE SIGNS

10 Device for dispensing a liquid product
12 Receiving body
14 Locking and fastening device
16 Adapter device
18 Inner container
20 Outer container
22 Upper part of the outer container
24 Lower part of the outer container
26 Wall adapter
28 Cover for covering the locking and fastening device
30 Base
32 Central axes extending through the device
34 First rail
36 Second rail
38 Curved end portions of the rails
40 Auxiliary tool
42 Lid
44 Guides of the rails
46 Central portion (or central piece) of the locking and fastening device
48 Openings
50 Window
52 Rear wall of the inner or outer container
54 Platform
56 Ring
58 Nozzle
60 Openings for dispensing a fragrance
62 Notch

The invention claimed is:

1. A device (10) for dispensing a liquid product comprising a receiving body (12), a locking and fastening device (14) and an adapter device (16)
characterized in that
the receiving body (12) is of multi-part design and comprises at least one inner container (18) for receiving the liquid product and an outer container (20) of two-part design, wherein the outer container (20) comprises an upper part (22) and a lower part (24) and is adapted to receive the inner container (18), wherein the receiving body (12) can be fastened to the adapter device (16) by means of the locking and fastening device (14), the locking and fastening device (14) comprises a first rail (34) and a second rail (36), the rails (34, 36) exhibiting a curved end portion (38) in their lower region, wherein the rails (34, 36) run essentially parallel to one another in a fastened state, and are configured to allow for the rails (34, 36) to be pressed apart in a region of the curved end portions (38) by means of an auxiliary tool (40).

2. The device (10) for dispensing a liquid product according to claim 1 characterized in that
the device (10) comprises a wall adapter (26), wherein the wall adapter (26) cooperates with the locking and fastening device (14) of the device (10) in such a way that the device (10) can be fastened to a wall.

3. The device for dispensing a liquid product according to claim 1 characterized in that
the device (10) comprises a cover (28) for covering the locking and fastening device (14), and a base (30), wherein the base (30) can be fastened to a lower region of the adapter device (16) and enables the device (10) to be installed on a substrate and/or fastened to a substrate.

4. The device (10) for dispensing a liquid product according to claim 3 characterized in that
the base (30) is formed such that an axis (32) extending centrally through the device (10) includes an angle of inclination with a plane formed by the substrate, the angle of inclination being less than 90°.

5. The device (10) for dispensing a liquid product according to claim 3 characterized in that
the device comprises an intermediate adapter (31) which provides a connection between the base (30) and the lower part of the adapter device (16).

6. The device (10) for dispensing a liquid product according to claim 1 characterized in that an upper portion of the locking and fastening device (14) comprises a lid (42).

7. The device (10) for dispensing a liquid product according to claim 1 characterized in that the adapter device (16) comprises guides (44) for guiding the rails (34, 36).

8. The device (10) for dispensing a liquid product according to claim 1 characterized in that the lower part (24) of the outer container (20) is firmly connected to the locking and fastening device (14).

9. The device (10) for dispensing a liquid product according to claim 1 characterized in that the inner container (18) is adapted to hold a volume of at least 300 ml of liquid product.

10. The device (10) for dispensing a liquid product according to claim 1 characterized in that the locking and fastening device (14) comprises means for preventing unwanted opening and/or replacement of the inner container by unauthorized personal.

11. The device (10) for dispensing a liquid product according to claim 1 characterized in that the locking and fastening device (14) comprises a central portion (46) which is integrated in a surface of the upper part (22) of the outer container (20).

12. The device (10) for dispensing a liquid product according to claim 1 characterized in that the lower part (24) of the outer container (20) comprises openings (48) to allow for an escape of air when the inner container (18) is presently inserted into the lower part (24) of the outer container (20).

13. The device (10) for dispensing a liquid product according to claim 1 characterized in that the device comprises a window (50) for indicating a filling level.

14. The device (10) for dispensing a liquid product according to claim 1 characterized in that the inner container (18) and/or the outer container (20) exhibit a substantially circular shape in cross section.

15. The device (10) for dispensing a liquid product according to claim 1 characterized in that the inner container (18) and/or the outer container (20) are constructed flat in a region of a rear wall (52).

16. The device (10) for dispensing a liquid product according to claim 1 characterized in that the adapter device (16) comprises a platform (54) exhibiting a substantially circular base area.

17. The device (10) for dispensing a liquid product according to claim 16 characterized in that the platform (54) exhibits a diameter of 2 cm to 5 cm.

18. The device (10) for dispensing a liquid product according to claim 1 characterized in that the locking and fastening device (14) comprises a ring (56), the ring (56) exhibits a visible height of 0.5 mm to 20 mm, preferably of 1 mm to 10 mm and more preferably of 2 mm.

19. The device (10) for dispensing a liquid product according to claim 1 characterized in that the dimensions of the inner container (18) correspond with the dimensions of the upper part (22) and/or the lower part (24) of the outer container (20) in such a manner that the inner container (18) may be inserted into the lower part (24) of the outer container (20).

20. The device (10) for dispensing a liquid product according to claim 1 characterized in that the device (10) exhibits a nozzle (58) for dispensing the liquid product, the nozzle (58) being removable from the device (10).

21. The device (10) for dispensing a liquid product according to claim 1 characterized in that the lower part (24) of the outer container (20) comprises openings (60) for dispensing a fragrance, wherein the fragrance is present in the lower part (24) of the outer container (20).

22. A kit for replacing the inner container for containing the liquid product in the device for dispensing the liquid product of claim 1, the kit comprising the device for dispensing the liquid product and the auxiliary tool for releasing the locking and fastening device.

* * * * *